United States Patent [19]

Aubin et al.

[11] 4,207,966

[45] Jun. 17, 1980

[54] MULTIPURPOSE STAGING HORSE

[76] Inventors: Jean-Marie Aubin, 1071 Tiffin, Longueuil, Quebec, Canada, J4P 3G7; Lionel Graveline, 348 St. Francois St., St-Hyacinthe, Quebec, Canada, J2S 5E8; Léonard Rioux, 307B St. Simon St., St-Hyacinthe, Quebec, Canada, J2S 5C1

[21] Appl. No.: 48,020

[22] Filed: Jun. 13, 1979

[51] Int. Cl.[2] ..... E04G 1/00

[52] U.S. Cl. ..... 182/181; 182/225; 269/296

[58] Field of Search ..... 269/296, 321 CF; 182/153–155, 181–185, 224–225

[56] References Cited

U.S. PATENT DOCUMENTS

| | | | |
|---|---|---|---|
| 789,156 | 5/1905 | King | 182/153 |
| 3,613,831 | 10/1971 | Estep | 182/181 |
| 3,637,045 | 1/1972 | Poffenbaugh et al. | 182/155 |

FOREIGN PATENT DOCUMENTS

| | | | |
|---|---|---|---|
| 837602 | 7/1949 | Fed. Rep. of Germany | 182/183 |
| 1045592 | 11/1953 | France | 182/225 |

*Primary Examiner*—Robert C. Watson

[57] ABSTRACT

A multipurpose staging horse is disclosed comprising two coplanar legs converging upwardly towards each other and rigidly secured near their upper ends by a horizontal bar member; the upper ends of the legs project vertically upward and form with the bar member a stirrup in which may be secured a beam of wood or the like; the stirrup includes in one of its arms a wing screw projecting transversely inward to secure said beam of wood; a transverse bar interconnects the legs near their lower end to maintain the same at their proper spacing and holds a pivotable brace projecting upwardly and away from the legs and also having a stirrup at its upper end aligned with the first named stirrup to receive the same beam of wood. The brace is slightly offset laterally from the center line of the two aligned stirrups so that two staging horses may be used as an oppositely positioned pair wherein their respective braces cross each other without interference.

2 Claims, 9 Drawing Figures

MULTIPURPOSE STAGING HORSE

FIELD OF THE INVENTION

This invention relates to improvements in adjustable staging horses and more particularly to a multipurpose staging horse adapted to serve in a variety of applications.

BACKGROUND OF THE INVENTION

Knockdown staging horses are known in the art but they are frequently complicated having a plurality of struts, braces and hinges which can make dismantling time-consuming and the whole structure relatively expensive.

Accordingly, it is a prime object of the present invention to provide a knockdown staging horse which is simple to erect, sturdy and inexpensive.

It is another object of the present invention to provide a staging horse which may be easily used by handy-men, children and women.

SUMMARY OF THE INVENTION

The staging horse according to the present invention is characterized by two co-planar spaced-apart, upright legs which converge towards each other upwardly and are joined together at their top end and near their bottom and by top and bottom horizontal bar members. The top end of the staging horse is further provided with an upwardly opening stirrup in which may be secured a beam to form whatever kind of supportive structure is desired. The staging horse further includes a pivotable brace which is mounted on the bottom bar member between the legs at its lower end and which also includes a stirrup at its top end aligned with the first named stirrup to receive the same beam. This brace is slightly offset laterally from the center line of the two aligned stirrup so that two staging horses can be fixed to the same beam by means of the stirrups with the braces crossing each other without interference.

BRIEF DESCRIPTION OF THE DRAWINGS

The above will be more clearly understood by referring to the preferred embodiments of the invention illustrated by way of the accompanying drawings in which.

DETAILED DESCRIPTION OF THE INVENTION

Figure 1:
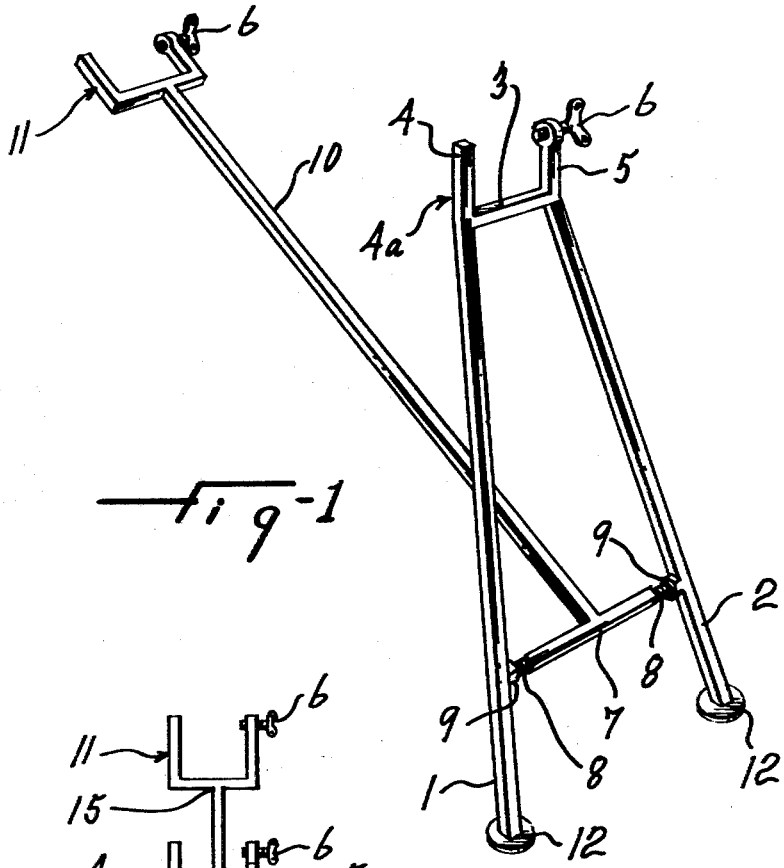
FIG. 1 is a perspective view of the staging horse.

The staging horse according to the first embodiment includes two legs 1 and 2 which converge towards their respective top ends where they are rigidly linked together by a first horizontal bar member 3. Legs 1 and 2 are slightly inclined to the vertical as clearly shown in FIG. 1.

Projecting above bar member 3 are two rigid, parallel and vertical arms 4 and 5 integral with legs 1 and 2. Arms 4 and 5 form a first stirrup **4*a* in which may be placed a beam of wood or the like. To secure the beam in the stirrup, a wing screw 6 is screwed into arm 5** and projects transversely therefrom, and may be adjusted, depending on the thickness of the beam.

Towards the lower end of legs 1 and 2, a second horizontal bar member, namely transverse bar 7, is pivotally secured to legs 1 and 2 at its outer ends. The pivot means consists of a screw thread portion 8 at each outer end of transverse bar 7 which screws into a nut 9 welded to the inner side of legs 1 and 2 respectively. Integral with transverse bar 7 is a brace 10 which is secured to transverse bar 7 and slightly laterally offset from the center of the latter. The reason for this is explained below.

Figure 2:
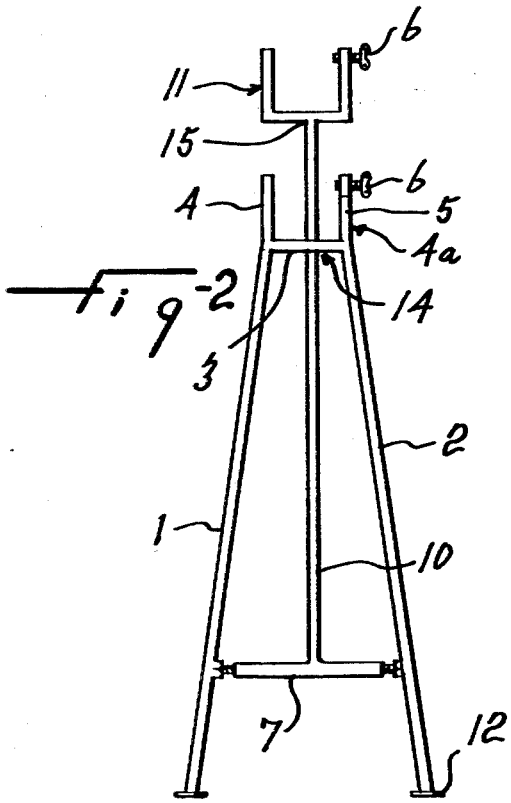
FIG. 2 is an end view of the staging horse according to a first preferred embodiment shown in FIG. 1.
Figure 3:
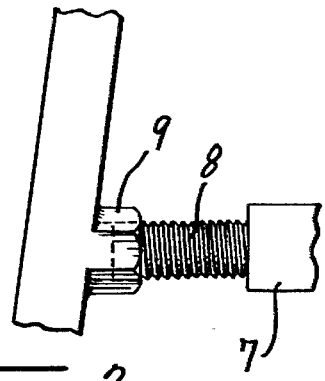
FIG. 3 is a sectioned and enlarged end view of the pivot means of the brace of the embodiment of FIG. 1.

Brace 10 also includes at its outer end a second stirrup 11, one of the arms of which is provided with a wing screw 6. Stirrup 11 is aligned with stirrup **4*a* as shown in FIG. 2 to receive the same beam. Therefore, brace 10 is laterally offset from the center line of stirrups 4*a* and 11**.

Legs 1 and 2 are each provided with feet 12 made of rubber or other friction material so that the staging horse will not slide or shift position while it is supporting something.

Figure 5:
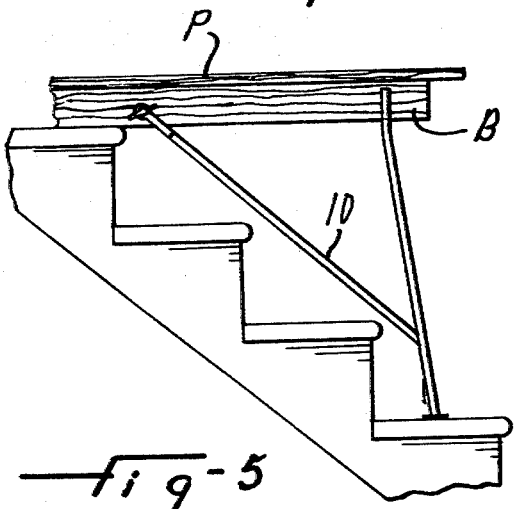
Figure 6:
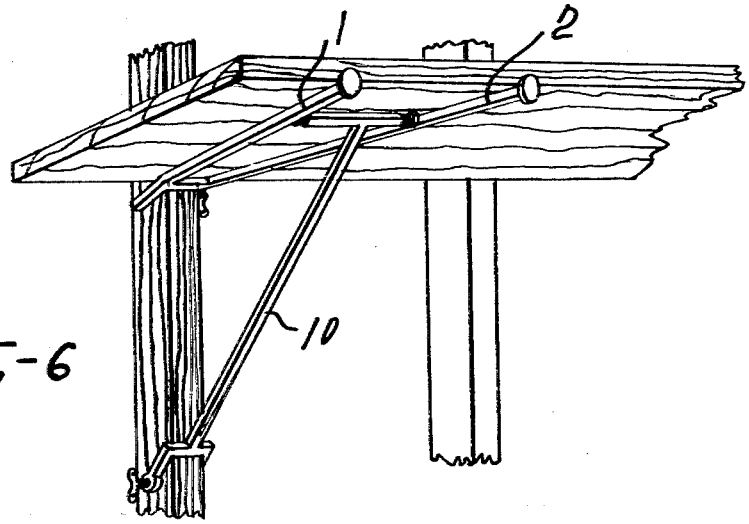

As shown in FIGS. 5 and 6, the staging horse may be used in a variety of applications. In FIG. 5, for example, two staging horses are used side by side on a stairway supporting a work platform P, by means of beams B, possibly for a wall repair or painting job in difficult to reach areas. FIG. 6 suggests another possible application of the staging horse in use as a wide shelving support.

Figure 4:
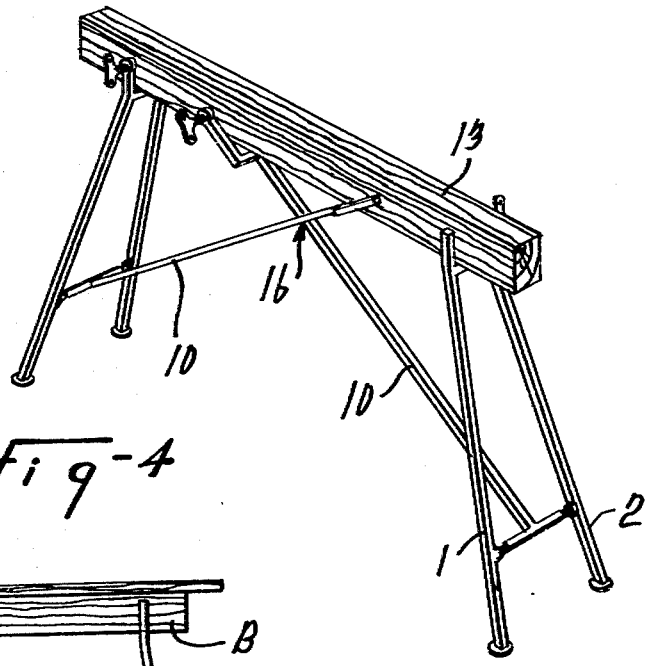
FIGS. 4–7 inclusively are views showing three different practical applications of the staging horse.

Another possible application of the staging horse is shown in FIG. 4, wherein two staging horses are used cooperatively as a pair. Leg members 1 and 2 support a beam of wood 13 at its outer ends and in their respective stirrups and braces 10 extending upwardly and inwardly to support beam 13 in its middle portion. In order that the braces 10 may cross each other as shown in FIG. 4 without interference with each other, each brace 10 is slightly laterally offset from the center line of the aligned stirrups **4*a* and 11 as clearly shown in FIG. 2 at 14 and 15 respectively. Thus, when the braces 10 are oppositely directed as in FIG. 4, they may cross each other at 16**.

Figure 7:
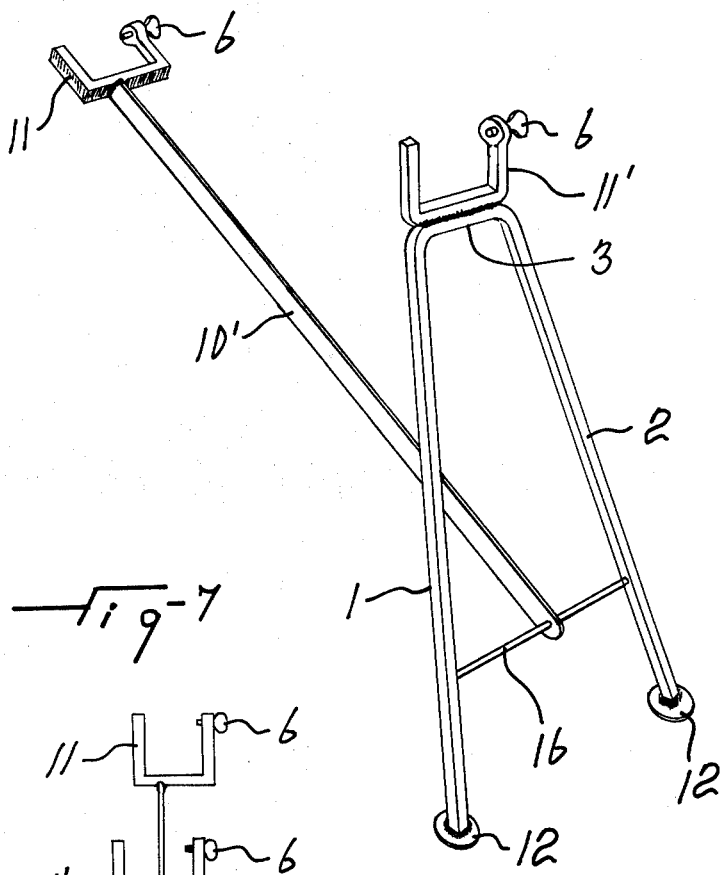
Figure 8:
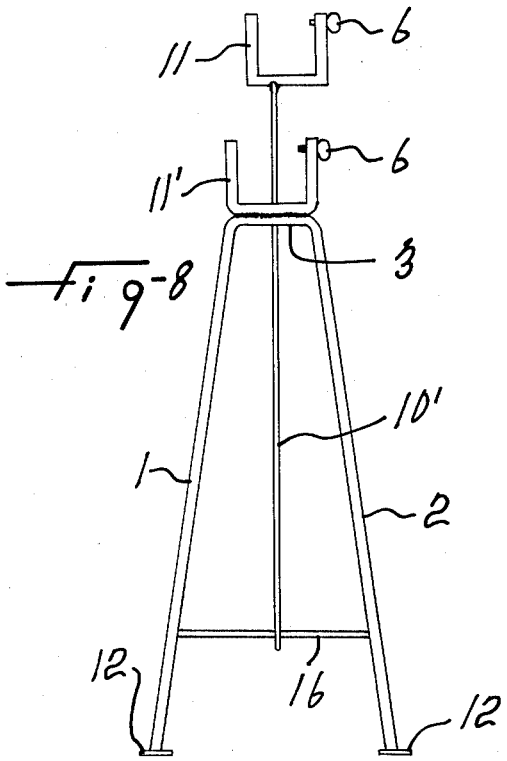
FIG. 8 is an end view of the staging horse shown in FIG. 7.

Referring now to FIGS. 7 and 8, a second preferred embodiment of the invention is disclosed. The staging horse herein includes legs 1 and 2 of the first embodiment, a horizontal bar member 3 integral with their respective upper ends, rubber feet 12 and, instead of transverse bar 7, a transverse rod 16 welded or otherwise rigidly secured to leg members 1 and 2. Brace 10' is laterally thin and is pivotally and slidably mounted on transverse rod 16 by means of a hole in its lower and whereby it can slide along transverse rod 16 as well as pivot. The upper end of brace 10' is provided with a rigidly secured and laterally offset stirrup 11 which has an adjustable wing screw on one of its arms.

Legs 1 and 2 of the second preferred embodiment are also provided with a stirrup 11' at their upper ends. However, the sitrrup 11' is not integral with legs 1 and 2 but is U-shaped and welded to horizontal bar member 3. Stirrup 11' is provided with a wing screw 6.

As shown in FIG. 8, because of the slidability of brace 10' along transverse rod 16, the two stirrups 11 and 11' may be positioned in different longitudinal planes, thereby allowing for the support of beams which are not straight. Normally, however, the two stirrups are positioned in alignment to receive a straight beam 13.

Figure 9:
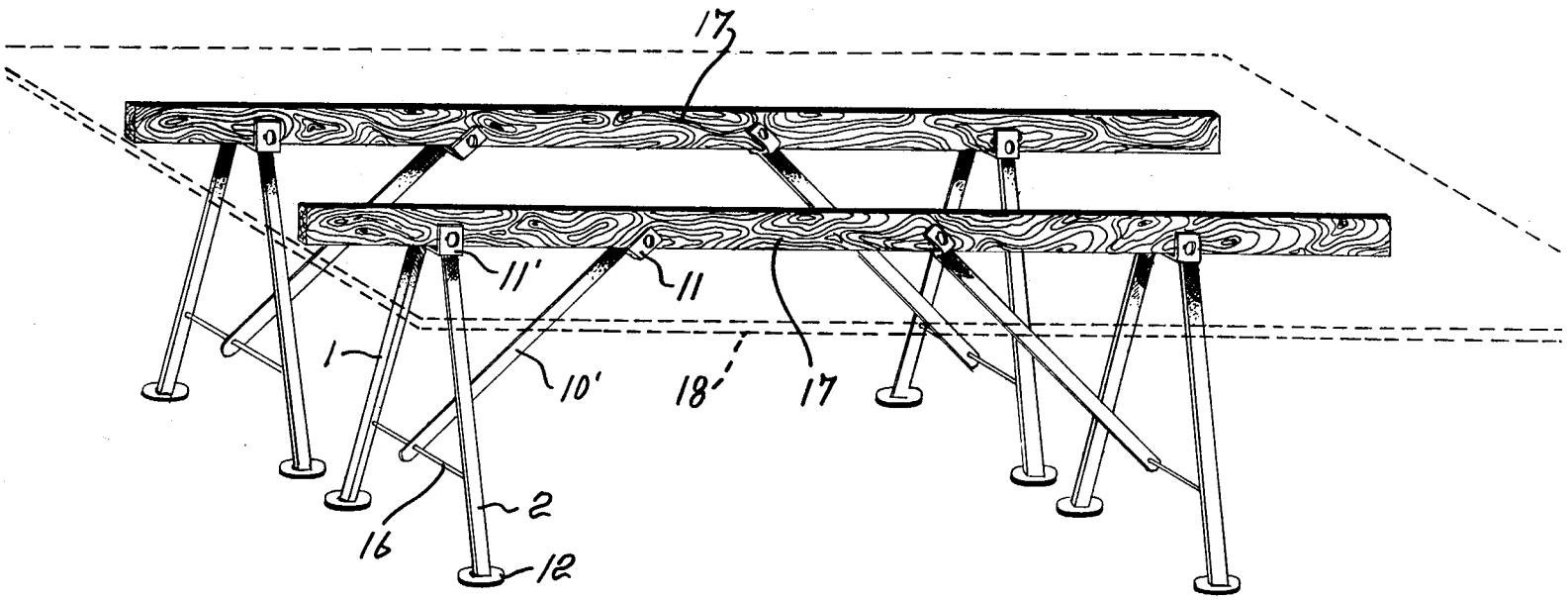
FIG. 9 is a perspective view of the second embodiment showing how two pairs of the staging horse may be used to support a table (shown in dashed outline).

FIG. 9 shows still another possible application of the staging horse according to the second embodiment of the invention but in which the first embodiment would serve just as well. Two long beams 17 are parallel to each other and each is supported by a pair of oppositely positioned and spaced-apart staging horses. The two beams 17 support a table 18 shown in dashed outline.

It is clear that setling up the staging horse according to either embodiment is a very simple matter: A beam is placed in the stirrup of the legs and tightened in place by wing screw 6 and then the brace 10 or 10' is positioned so that its stirrup will receive another portion of the beam and is also tightened by wing screw 6. Braces 10 or 10' can be crossed, if necessary, if the supported beam is relatively short.

What we claim is:

1. A multipurpose staging horse comprising two generally upright, spaced-apart and coplanar legs which converge towards each other upwardly, said legs being rigidly secured together near their upper and lower ends by top and bottom horizontal bar members respectively, a first upwardly opening U-shaped stirrup rigid with said top horizontal bar, a brace pivotally and slidably mounted on said bottom horizontal bar member at its lower end, and a second, upwardly opening U-shaped stirrup secured to the upper end of said brace, screw means projecting transversely inwardly through one side of each of said stirrups for tightening a beam of wood or the like received and supported in said stirrups, said brace being slightly laterally offset from the center line of said second stirrup, so that the same beam can be received and supported by the stirrups of a pair of staging horses with their respective braces crossing each other without interference.

2. A multipurpose staging horse as defined in claim 1, wherein said brace has a transverse hole in its lower end, and said bottom horizontal bar member is a transverse rod which passes through said hole and is rigidly secured to each leg near their lower ends, said brace pivotable about and slidable along said rod.

* * * * *